US005183182A

United States Patent [19]

Comstock et al.

[11] Patent Number: 5,183,182

[45] Date of Patent: Feb. 2, 1993

[54] LIQUID DISPENSER FOR VERTICAL WALL MOUNTING

[75] Inventors: Roger D. Comstock; Ryan K. Tischner, both of Orem; Wayne E. Pearce, Provo, all of Utah

[73] Assignee: Better Living Products, Provo, Utah

[21] Appl. No.: 653,142

[22] Filed: Feb. 11, 1991

[51] Int. Cl.[5] ..... B67D 5/56

[52] U.S. Cl. ..... 222/129; 222/153; 222/156; 222/181; 222/514; 222/559

[58] Field of Search ..... 222/153, 156, 157, 129, 222/181, 514, 559

[56] References Cited

U.S. PATENT DOCUMENTS

| | | | |
|---|---|---|---|
| 3,078,016 | 2/1963 | Judy . | |
| 3,195,777 | 7/1965 | Hart | 222/181 |
| 3,814,294 | 6/1974 | Stevenson | 222/181 |
| 3,920,160 | 11/1975 | Casale et al. . | |
| 3,955,715 | 5/1976 | Topor . | |
| 3,987,932 | 10/1976 | Maldon | 222/129 |
| 4,159,788 | 7/1979 | Doyel | 222/181 |
| 4,164,306 | 8/1979 | Perrin | 222/181 |
| 4,166,553 | 9/1979 | Fraterrigo . | |
| 4,238,056 | 12/1980 | Tucker et al. | 222/181 |
| 4,324,348 | 4/1982 | Johnson et al. | 222/181 |
| 4,470,523 | 9/1984 | Spector . | |
| 4,667,854 | 5/1987 | McDermott et al. | 222/181 |
| 4,715,517 | 12/1987 | Potter et al. | 222/181 |
| 4,741,461 | 5/1988 | Williamson et al. | 222/181 |
| 4,793,517 | 12/1988 | Washut . | |
| 4,880,145 | 11/1989 | McManus | 222/181 |
| 4,886,192 | 12/1989 | Cassia | 222/181 |
| 5,033,657 | 7/1991 | Whittington | 222/181 |

FOREIGN PATENT DOCUMENTS

| | | | |
|---|---|---|---|
| 269668 | 6/1965 | Australia | 222/181 |
| 749596 | 1/1967 | Canada | 222/181 |

OTHER PUBLICATIONS 2 pages of advertisement from "Solutions" of Portland, Oreg. for a two or four section shower soap dispenser, Jan. 1991.

*Primary Examiner*—Robert P. Olszewski
*Assistant Examiner*—Steven M. Reiss
*Attorney, Agent, or Firm*—Mallinckrodt & Mallinckrodt

[57] ABSTRACT

A liquid dispenser device comprising a shell adapted to be wall-mounted substantially vertically in a bathing or washing area and to removably and replaceably receive and hold one or more elongate bottles for liquids useful before, after, or while bathing, each bottle having a valve assembly operable by a push button along an axis extending substantially normal to the longitudinal axis of its associated bottle as positioned substantially vertically for use. The shell has a hinged and preferably lockable cover part that can be propped open when raised for allowing a bottle to be removed for refilling. Most of the components of the dispenser device are preferably fabricated from a thermoplastic material, as by well-known injection molding techniques.

21 Claims, 6 Drawing Sheets

LIQUID DISPENSER FOR VERTICAL WALL MOUNTING

BACKGROUND OF THE INVENTION

1. Field

This invention is in the field of liquid dispensing devices adapted for attachment to a wall in or near a shower bath or other bathing or washing facility and to contain liquid soap, shampoo, and other cleansing or grooming liquids normally used before, during or after bathing.

2. State of the Art

Many wall mounted devices for dispensing liquids are known. However, the manner in which they are refilled after use poses a problem. Specifically, a number of these prior art devices are permanently mounted on a wall and hence must be refilled without removal from the mounting location. Such refilling can be hazardous, since dispensing devices of this nature are commonly mounted in a shower or bathtub where it is both slippery and difficult to maneuver. Those that are detachable from their mountings require either disassembly or the exertion of considerable effort to remove. Some have portable containers that must be discarded and replaced with new full containers. Further, valves used in these devices to dispense the contained liquids are prone to leak and thereby produce hazardous conditions in the bathing area.

SUMMARY OF THE INVENTION

In accordance with the invention, a shell adapted to be wall-mounted vertically includes a preferably lockable hinged cover and a desired number of completely removable bottles, each provided with its own no-drip valve assembly which may be easily detached for cleaning or repair if necessary. The shell is adapted for mounting on the wall of a shower or at a wall location near a sink preferably by either the use of screws, with or without anchors set into the wall, or by a two-sided adhesive pad carrying a silicone glue.

Manually-operated push buttons for opening resiliently closed valves extend through the cover of the shell for ready accessibility, and such cover is preferably constructed to stay propped open when lifted for removal of one or more of the individual bottles for refilling. Apertures may be provided in the cover of the shell for viewing the level of liquid in the respective bottles as they reach the near empty stage.

The component parts of the shell are advantageously molded from a thermoplastic material and preferably include an integrally formed latch arrangement that releasably secures the cover in its closed position and that permits it to be lifted to open position.

The bottles, with their respective valve assemblies, are each mounted within the shell by integrally molded guide members and jaw members, the jaw members enabling the valve assemblies to be snapped into place in the shell. Each bottle has its corresponding valve assembly attached over a discharge opening at the bottom of the bottle, preferably by screw threads, and has a fill-opening at its top preferably covered by a soft plastic lid, which has a small hole to allow air to flow freely into the bottle as the contents are depleted. The bottles are preferably made of a clear plastic material and are easily removed from and replaced in the shell.

The valves are preferably constructed of preformed, injection molded, thermoplastic components that snap together and are held without aid of glue or other adhesive means. Each valve is spring biased to a closed leak-free condition, and is opened manually by a readily accessible push button to allow gravity flow of the desired liquid from the corresponding bottle into the cupped hand or hands of the user held directly below.

THE DRAWINGS

In the drawings, which represent the best mode presently contemplated for carrying out the invention in actual practice:

FIG. 1 represents a perspective view looking toward the front of a liquid dispenser device of the invention having multiple bottles for liquid to be dispensed and showing how the device would appear as attached to the wall of a shower or other bathing or washing area;

FIG. 2, a bottom plan view of the device of FIG. 1 as there shown;

FIG. 3, a corresponding view in side elevation;

FIG. 4, a rear elevational view;

FIG. 5, a view corresponding to that of FIG. 1, except with the cover in the open position;

FIG. 6, a view in side elevation of one of the containers and its valve assembly as removed from the liquid dispenser device of FIG. 1;

FIG. 7, a fragmentary front perspective view of the dispenser device of FIG. 1 with cover open and the containers and their valve assemblies removed;

FIG. 8, a fragmentary detail section taken along he line 8—8 of FIG. 2 and drawn to a larger scale;

FIG. 9, a similar view taken along the line 9—9 of FIG. 5;

FIG. 10, a vertical axial section through a valve as taken on the line 10—10 of FIG. 2, with the shell omitted;

FIG. 11, an exploded view of the valve assembly of FIG. 10, with the several parts being shown in elevation;

FIG. 12, a detail view in top plan of the valve body per se as viewed from the line 12—12 of FIG. 11;

FIG. 13, a vertical axial section through the valve housing taken on the line 13—13 of FIG. 12;

FIG. 14, a view corresponding to that of FIG. 6 but exploded to show how the cover of the bottle may be removed for refilling of the bottle and to show the several internal parts of the check valve, an intermediate part of the bottle being broken out for convenience of illustration;

FIG. 5, a view corresponding to the lower part of FIG. 1, considerably enlarged and with portions of the front wall broken away to reveal otherwise hidden structure, but showing another embodiment having snap locking and key unlocking means instead of the thumb-operated latching means of the first embodiment; and FIG. 16, a fragmentary vertical section taken on the line 15—15 of FIG. 14 and otherwise corresponding to FIG. 8.

DETAILED DESCRIPTION OF THE ILLUSTRATED EMBODIMENTS

Figure 5:
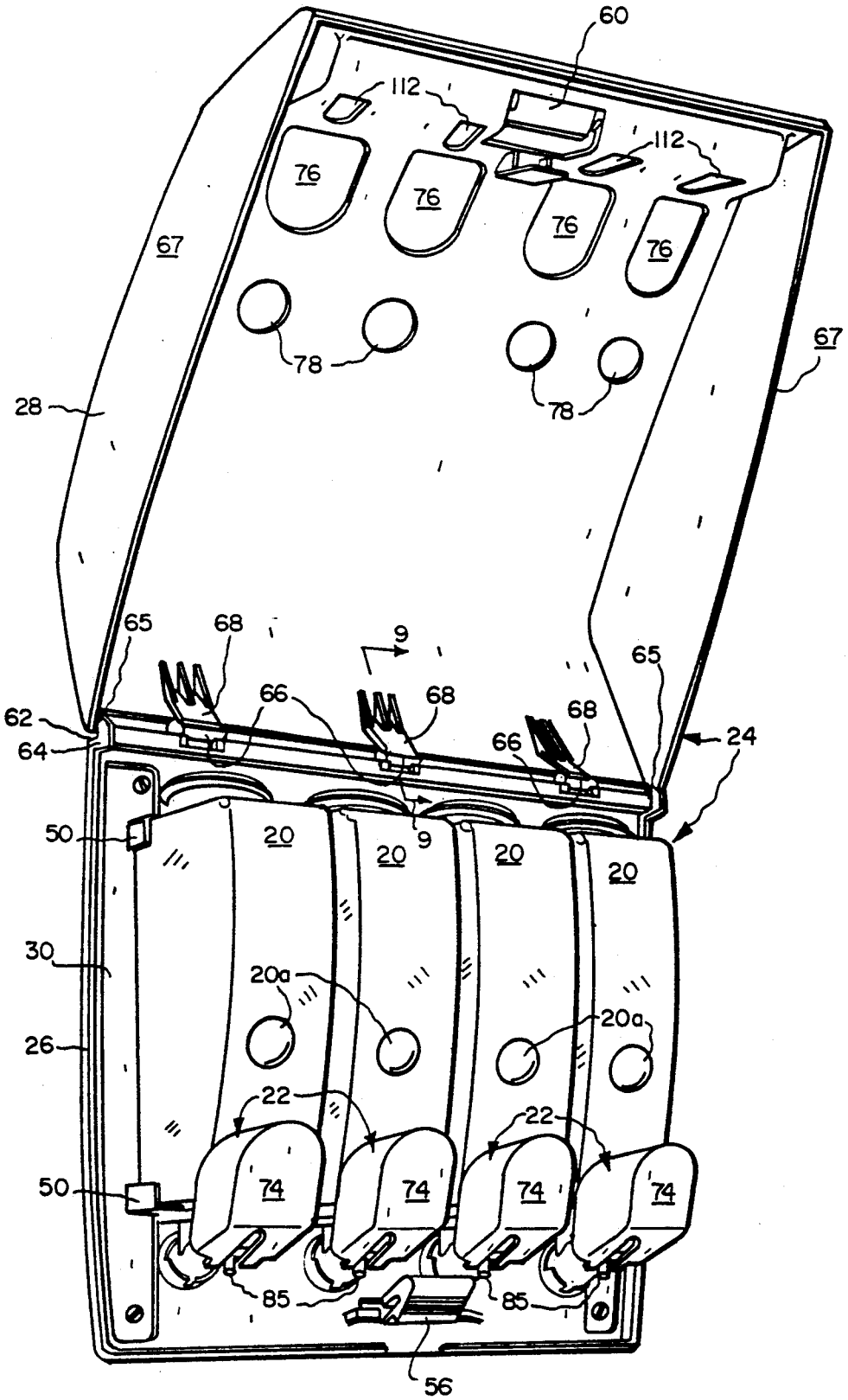

The dispenser device of the invention in its presently preferred form comprises a plurality (here shown as four) of identically shaped and fabricated bottles 20, FIG. 5, for holding various liquids, respectively, useful for example in the bath, each bottle having a compression-activated, liquid-releasing valve 22 attached thereto. The bottles are removably held within a shell 24, which is adapted to be mounted on a vertical wall in a shower or other bathing or washing area.

Figure 4:
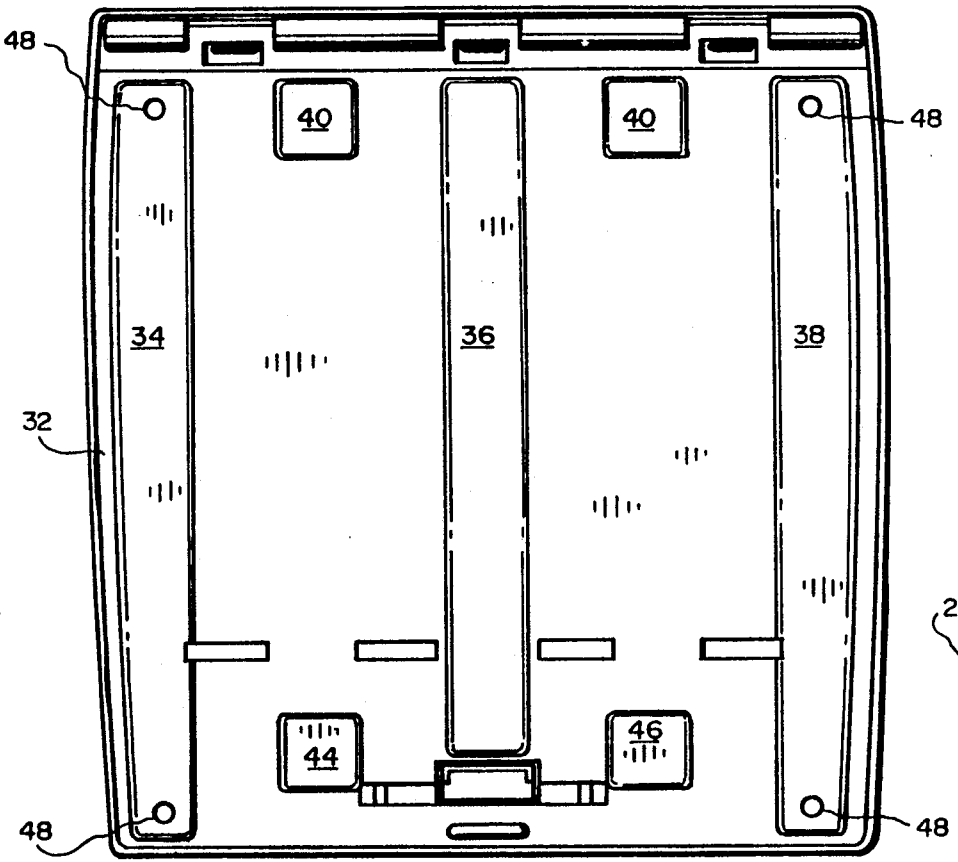
Figure 3:
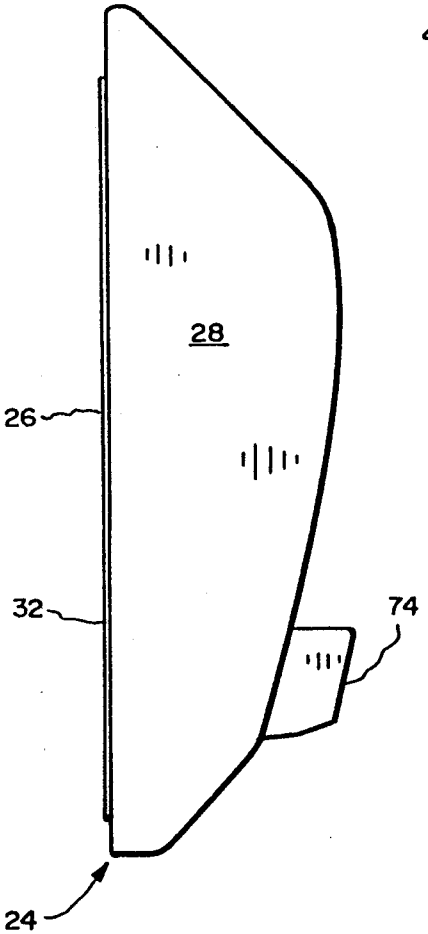

As shown, shell 24 has two main parts, a bottle-holding part 26, which is adapted to be mounted directly on a wall, and a hinged cover part 28. Together, holder part 26 and cover part 28 receive and enclose the bottles 2 and their respective valves 22. These two parts are desirably separately injection molded in conventional manner from a suitable thermoplastic material of stiffly resilient character to provide snap-action holding capability for retaining the bottles 20, and for latching capability relative to each other. Holder part 26 has a broad front or inside face 30 arranged to receive and hold the bottles and a broad back face 32, FIG. 4, adapted to confront and attach to a supporting wall surface by means of an adhesive and/or screws. Back face 32, as shown in FIG. 4, has three raised strips 34, 36 and 38 and four raised squares 40, 42, 44 and 46. The strips are raised slightly higher than the squares for receiving a silicone-based glue which may be used to attach the dispenser device to a vertical wall. Each of the squares 40, 42, 44 and 46 can receive a piece of two-sided adhesive foam. The adhesive foam and glue provide one way the dispenser device can be securely mounted.

Strips 34 and 38, as shown, each have a hole 48 drilled or otherwise formed therethrough near each end. Each hole 48 can accommodate a screw, this being an additional or alternative way the dispenser device can be mounted on a wall.

Figure 7:
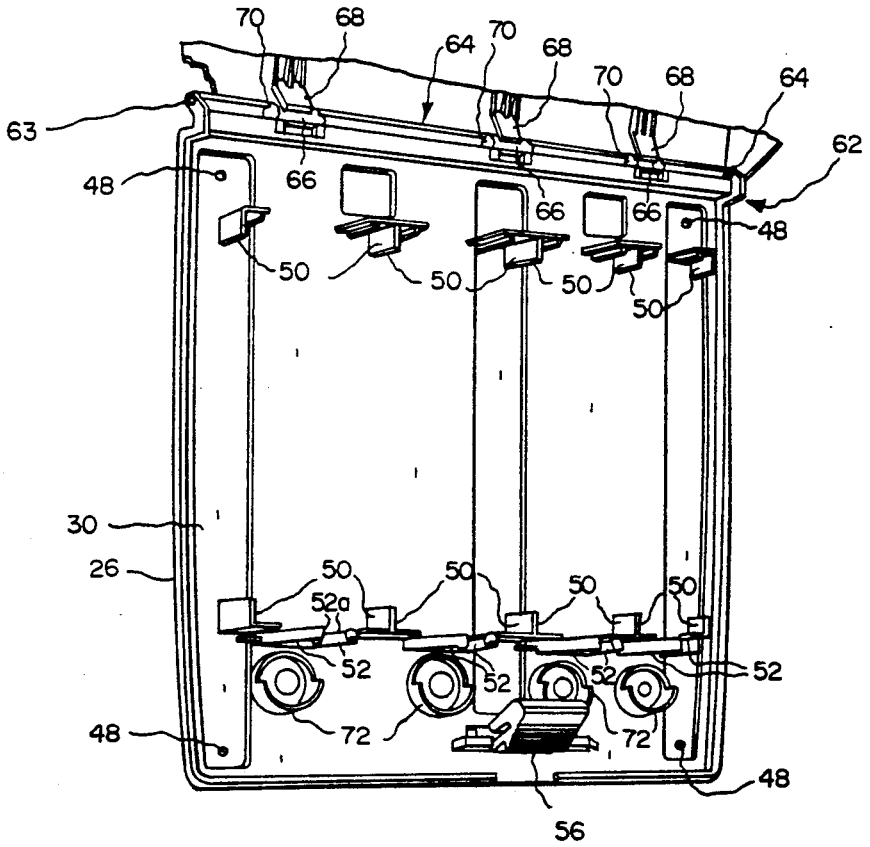

The inside face 30 of shell part 26 includes sets of integrally molded, upstanding, corner guide members 50, FIG. 5, and also corresponding sets of paired jaw members 52, FIG. 7, for receiving and holding the respective bottles 20 with their valve assemblies 22. An advantage of this arrangement is that each bottle 20 can be quickly and easily removed separately as and when required for refilling or cleaning. As shown, the tips 52*a* of each set of jaw members 52 are biased slightly inwardly toward each other in the form of tabs to maintain a firm grip on the valves 22 after such valves are snapped into place.

Bottle holder part 26 of the shell also has a latch piece 56 integrally molded therewith and rising from face 30 thereof for snap locking engagement with a cooperative latching part 60, FIG. 5, on cover part 28 of the shell to latch the shell in closed condition during use. Cover part 28 is released by pressing inwardly against latch piece 56.

The two parts 26 and 28 of the shell are hinged together along the back margin thereof which is uppermost in the wall-installed position of the shell and which is opposite the latching members 56 and 60.

Figure 9:
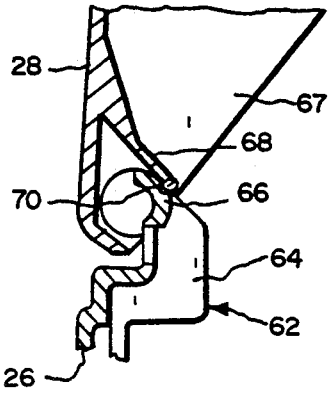
Figure 10:
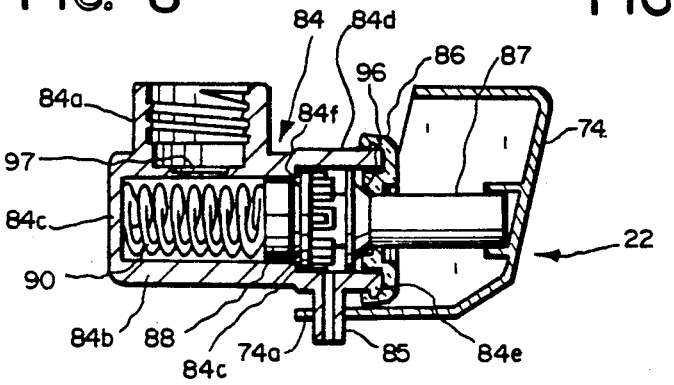

For this purpose, bottle-holding part 26 is provided along its back margin with a raised formation 62, FIGS. 5, 7, and 9, having, at its opposite ends, openings 63, FIG. 7, for receiving respective stub pintles 64 projecting inwardly from the back ends of cover side walls 65 which overlap the opposite ends of formation 62.

A unique feature of the dispenser device of the invention as preferably constructed is the provision of means, also FIGS. 5, 7, and 9, for automatically propping cover part 28 of shell 24 open in the vertical wall-mounted position of the device. This enables the user to conveniently and safely remove and replace the bottles 20 for refilling, to service the valve assemblies 22, and to conveniently mount the device on a wall with screws, if desired. As shown, formation 62 is provided with a series of arcuate retaining members 66 extending longitudinally therealong concentrically with the hinge axis, and cover part 28 is provided with a corresponding series of resilient tabs 68 bearing against such retaining members, respectively, to seat in respective grooves 70, FIG. 9, when the cover part is fully raised.

Figure 13:
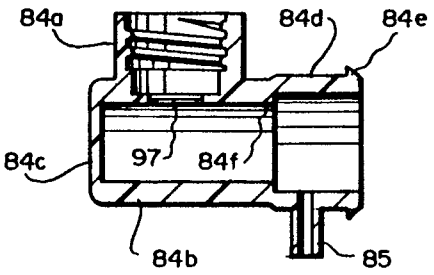
Figure 12:
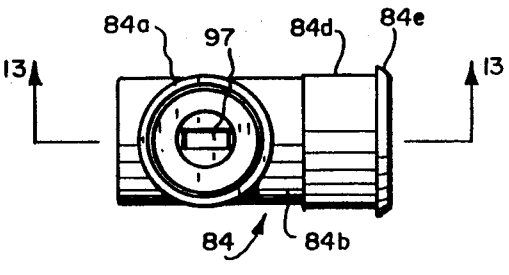

Each bottle 20 is preferably molded from a transparent thermoplastic material of shape that provides for close side-by-side positioning of a plurality of bottles on the inside face 30 of holder shell part 26, with closed ends 84*c*, FIG. 13, of their valves 22 abutting such face 30 Within respective receiving and positioning rings 72, FIG. 7, that are desirably integrally molded with such shell part and rise from such face 30.

Figure 1:
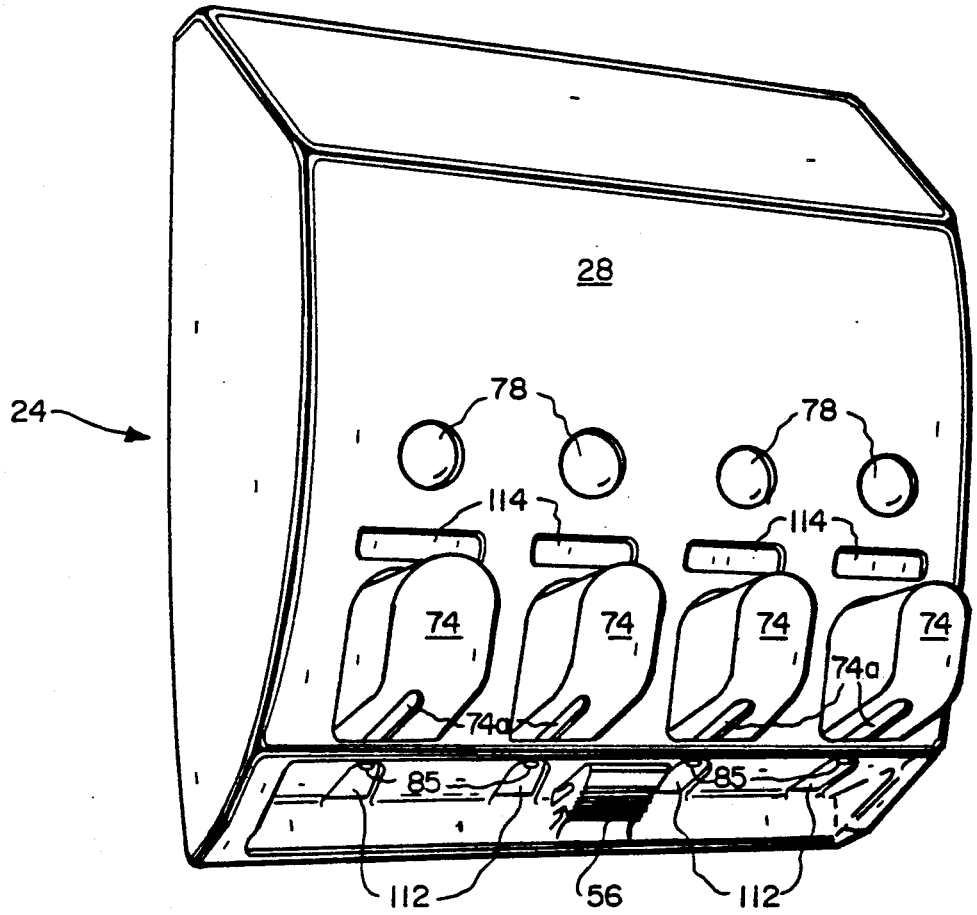

Valves 22 are arranged to open and close along respective axes that extend at right angles to the longitudinal axes of the respective bottles 20 so their manually actuatable push buttons 74 will confront and be readily accessible to the user when the device is mounted vertically on a wall as shown in FIG. 1.

Figure 6:
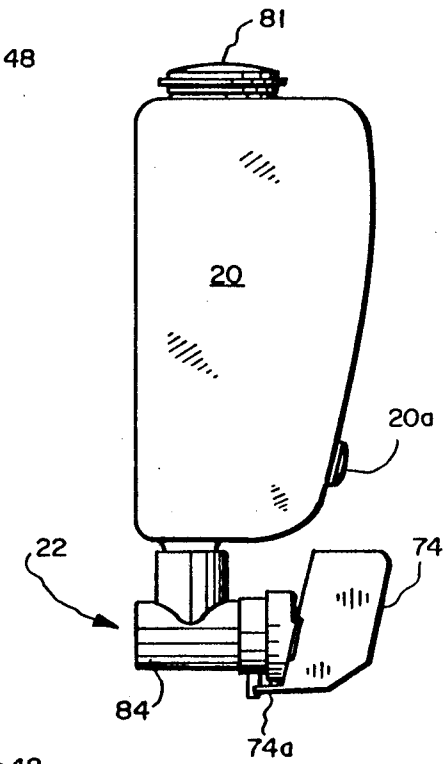

For accommodating push buttons 74, cover part 28 is correspondingly apertured, as at 76, FIG. 5, so that such push buttons and the portions of valves 22 covered thereby will project through and be accessible from outside of shell 24. It is advantageous also that cover part 28 have openings 78 above the push buttons so that lowering of liquid level in the respective bottles 20 can be observed to warn the user when refilling of the bottle or bottles concerned should take place. For filling and refilling, each bottle 20 has a top opening normally closed by a replaceable cover 80, FIGS. 6 and 14, which is provided with a small opening 82 establishing communication of the interior of the bottle with the atmosphere. Also, it is preferable that each bottle have a window 20*a*, FIGS. 5 and 6, for intrusion into the corresponding opening 78 of shell cover part 28 when such part is closed.

Figure 14:
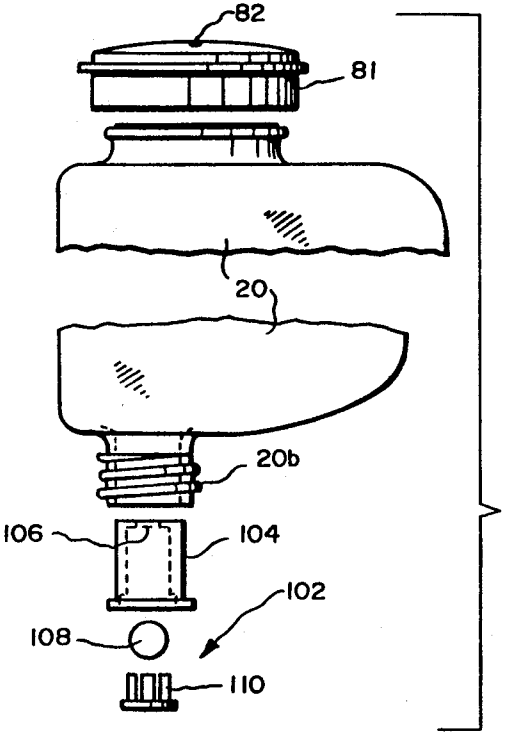

Each of the valves 22 comprises an assembly of mechanism, FIGS. 10–13, operably housed in a valve body 84, of right angular configuration having an internally threaded, normally upstanding portion 84*a* adapted to screw onto an externally threaded, depending, outlet nipple 20*b*, FIG. 14, of a bottle 20, and having a normally horizontal body portion 84*b* at right angles to portion 84*a* and into which is fitted the valve mechanism to be manually operated by push button 74. A discharge spout 85 depends from the open, push-button-mounting end portion 84*d* of valve body portion 84*b*, which open end portion is closed by an annular slideway cap 86, FIGS. 10 and through a central opening 86*a* of which slidably extends a piston or plunger rod 87 that is secured to push button 74 and has a piston or plunger head 88 against which one end of a coil spring 90 bears. The other end of spring 90 bears against the closed end 84*c* of valve body 84. Slideway cap 86 is desirably formed of a resilient thermoplastic material that snaps into fixed position over an annular lip 84*e* formed externally of the open end of valve body portion 84*d*.

A sealing washer 92 is carried by piston or plunger rod 87 and is normally pressed against the underside of piston or plunger head 88 by a slide ring 94 and by a second sealing washer 96 (both washers and the slide ring being slidably carried by piston or plunger rod 87) under the resilient action of spring 90. When push button 74 is pushed by a user to discharge liquid from the bottle through spout 85, slide ring 94 and washer 96 are restrained from following piston or plunger head 88 under the restricted opening 97, FIGS. 12 and 13, of valve body portion 84*a* by an annular internal shoulder 84*f*, FIG. 13, of valve body 84. Since slide ring 94 is formed with a circumferential series of diametrically opposite openings 98 therethrough leading to a corresponding series of passages 99 between teeth members 100, liquid descending by gravity through restricted opening 97 flows around piston or plunger rod 87 and through openings 98 and passages 99 into, through, and out of discharge spout 85 and into the cupped hands of the user held therebelow while push button 74 is held pressed by a thumb of the user. Release of the push button enables spring 90 to push the piston or plunger back into valve-closed position, with washers 92 and 96 firmly seated against slide ring 94 and against an annular seat member 86*b* of slideway cap 86 to effectively prevent leakage.

Figure 11:
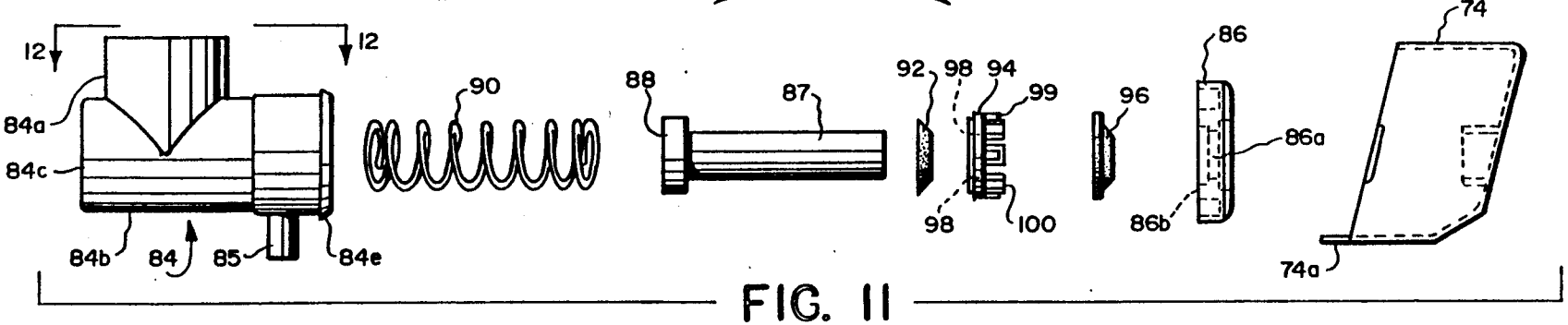

Push button 74 preferably has a rearwardly extending and slotted guide member 74*a*, FIG. 11, that engages spout 85 during the back and forth movement of such push button.

To prevent possible backflow of any residual liquid from dispensing valve 22 into bottle 20 through outlet nipple 20*b* thereof, such nipple is provided with a check valve 102, FIG. 14, comprising in this instance an insert valve body 104 having a valve seat 106 defining the opening for discharge of liquid from the bottle. A ball 108 is confined internally of valve body 104 between valve seat 106 and the upper end of a circumferential series of upstanding, spaced arms 110 that normally support ball 108 in position to immediately rise with any backflow of liquid from valve 22 and seat against valve seat 106 to prevent further backflow. When ball 108 rests on top of arms 110, as it does normally, liquid from bottle 20 flows freely into and through dispensing valve 22 when such valve is open.

Figure 2:
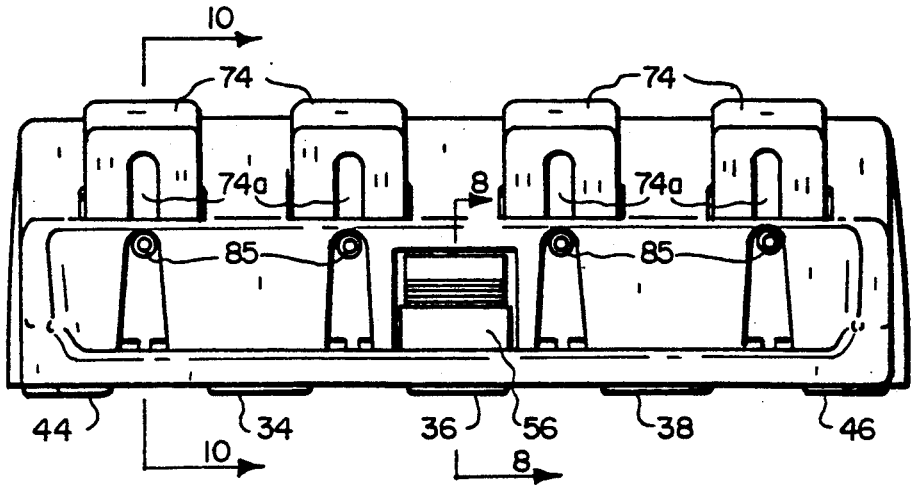

The valve spout 85 of each bottle 20 is directed toward a corresponding opening 112, FIGS. 1, 2, and 5, in cover part 28 of shell 24 and the dispensed liquid drops through such opening into the hand or hands of the user.

It is advantageous that recesses 114, FIG. 1, be provided in shell cover part 28 above the respective push buttons 74 for the reception of name plates identifying the liquids in the respective bottles 20.

Figure 8:
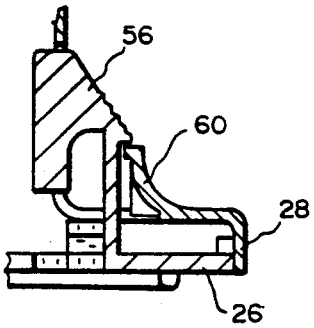
Figure 15:
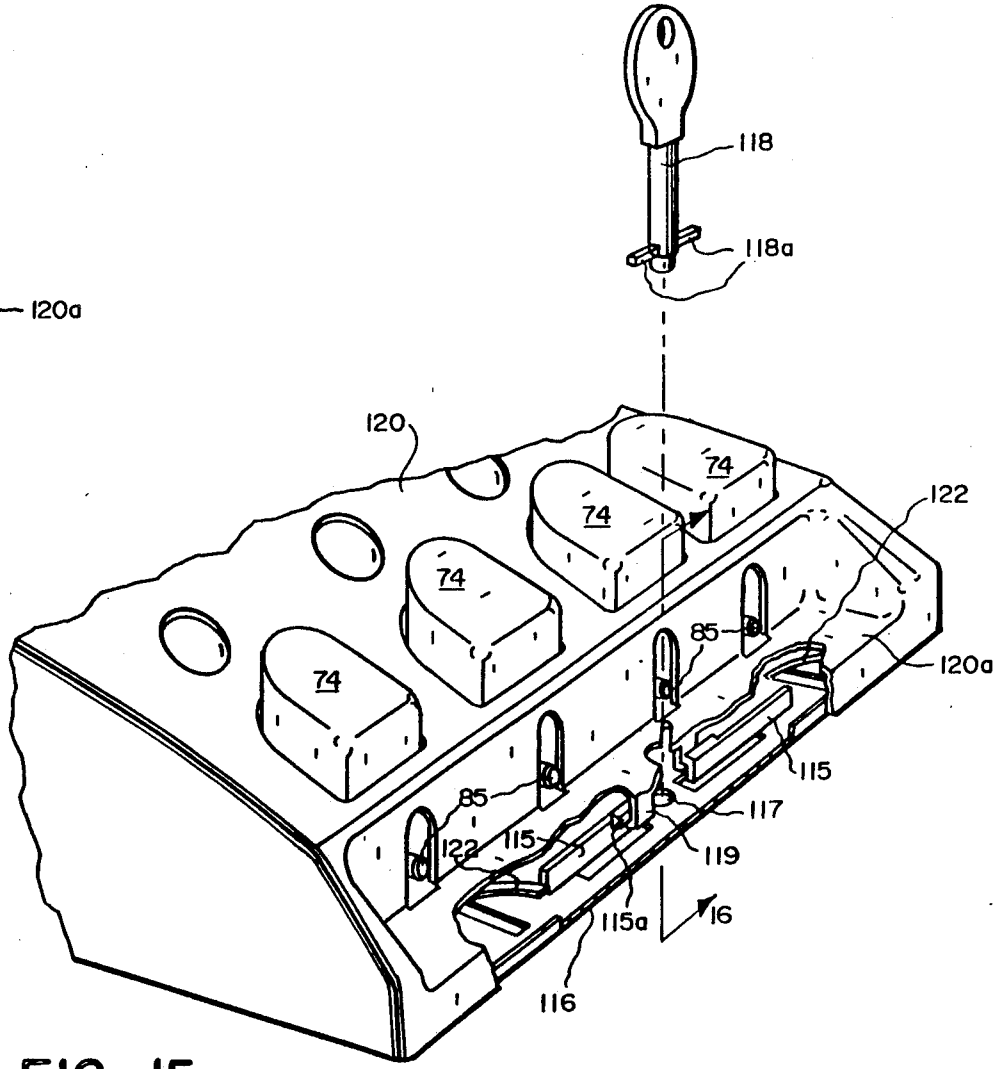
Figure 16:
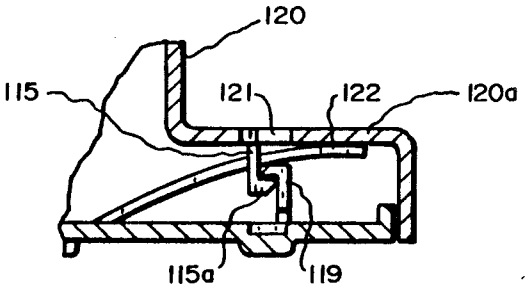

The embodiment of FIGS. 15 and 16 corresponds in major respects to the foregoing embodiment, but provides for snap locking and key unlocking of the shell. As shown, it has four of the bottles 20, each with a valve 22 operated by a push button 74 and dispensing liquid from the bottle through a discharge spout 85. Instead of the latching members 56 and 60 of FIG. 8, it is provided with a key-actuated lock.

As shown, such lock comprises a pair of elongate, rigid, tab members 105 rising from the inside face of bottle-holding shell part 106 at opposite sides, respectively, and staggered forwardly and backwardly, respectively of a recess 107 provided in such inside face of shell part 106 for receiving the end of a separate key 108. The tab members 105 have hook portions 105*a* at their ends immediately adjacent to recess 107 for snap-locking interengagement with a corresponding pair of hook members 109 that depend from the inside face of the front shelf portion 110*a* of cover shell part 110 at opposite sides, respectively, of a key-hole 111 in such front shelf portion of the cover shell part and staggered correspondingly with the staggering of members 105 relative to key-end-receiving recess 107.

Since elongate tab members 105 are attached to bottle-holding shell part 106 only at their end portions remote from recess 107, so that the remainders of their respective lengths are resiliently cantilevered toward the keyhole, oppositely extending pin members 108*a*, respectively, of key 108 serve to push hook portions 105*a* of such resiliently cantilevered tab members out of locking engagement with hook members 109 when the key is turned clockwise in the keyhole. If the arrangement and staggering of the hook members is the reverse of that shown, the key would be turned counterclockwise in the keyhole.

In conjunction with the aforedescribed locking means, it is advantageous to provide upwardly cantilevered, elongate, resilient, cutout tabs 112 that oppositely flank such locking means and tend to push up cover shell part 110 upon unlocking disengagement of the hook members.

Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A liquid dispensing device, comprising a shell for enclosing one or more liquid-containing bottles, said shell having a part for receiving and holding said one or more bottles and a cover part for the bottle holding part, said cover part of the shell being hinged to the bottle-holding part of the shell along a side thereof that will be uppermost when the device is installed in vertical position on a wall, and including a series of arcuate retaining members extending longitudinally along that side of the bottle-holding part of the shell that will be uppermost and concentric with the hinge axis between bottle-holding part and cover part, and a corresponding series of resilient tabs extending along said side of the cover part of the shell that will be uppermost and having ends bearing against the arcuate surfaces of corresponding ones of said members, respectively, said arcuate surfaces having respective grooves into which said ends of said tabs fits when said cover of the shell is opened to thereby maintain the cover part of the shell in propped-open condition until moved to closed condition; one or more elongate bottles adapted to be received and held by said bottle-holding part, each of said one or more bottles having a liquid-dispensing opening with valve means at its bottom, said valve means including mechanism that is operable back and forth along an axis substantially normal to the longitudinal axis of its associated bottle by means of a push button that is adapted to extend through said cover for manual operation by the user of the device for operating said valve means, and having a downwardly extending, discharge spout through which liquid from its associated bottle will be discharged when the valve means is operated, and resilient means for returning the push button and valve mechanism to closed position; and means whereby said shell can be attached to a wall, with said bottle or bottles positioned substantially vertically.

2. A liquid-dispensing device according to claim 1, wherein there are a plurality of bottles and the bottle-holding part of the shell is adapted to receive and hold said bottles in close side-by-side relationship.

3. A liquid dispensing device according to claim 1, wherein one or more bottle-viewing apertures corresponding to the one or more bottles are formed in the shell cover part adjacent to the valve means for enabling a user to determine when the bottle or bottles should be refilled.

4. A liquid dispensing device according to claim 1, wherein the one or more bottles are provided in their upper ends with respective refilling orifices and removable and replaceable covers for said orifices, respectively.

5. A liquid dispensing device according to claim 1, wherein means are also provided between said cover part and said bottle-holding part for latching said cover part in closed position.

6. A liquid dispensing device according to claim 1, including key-unlockable, snap-locking means for preventing unauthorized opening of the shell.

7. A liquid dispensing device, comprising a shell for enclosing one or more liquid-containing bottles, said shell having a part for receiving and holding said one or more bottles and a cover part for the bottle holding part; one or more elongate bottles adapted to be received and held by said bottle-holding part, each of said one or more bottles having a liquid-dispensing opening with valve means at its bottom, each valve means including a valve body of substantially right angle formation having a first elongate body member containing valve mechanism, and a second body member extending at substantially right angles to the first body member at one end thereof which is otherwise closed, said second body member being adapted for attachment over the bottom discharge opening of a bottle, a discharge spout extending downwardly from said first body member in offset relationship to said second body member, said valve member mechanism comprising a plunger slidable within said first body member and having a plunger rod with one end attached to a push button that is adapted to extend through said cover for manual operation by the user of the device for operating said valve means and with a plunger head on the opposite end within sand slidable back and forth in said first body member, valve sealing means carried by said plunger rod between said ends thereof, a slideway cap closing the end of said first body member opposite said one end and through which said plunger rod slidably extends, a spring bearing against said headed end of the plunger to normally urge said plunger away from said one end of the first body member and toward said slideway cap so said plunger head will bear against said valve sealing means which will be positioned against said slideway cap over said discharge spout to thereby seal the valve against leakage and to urge said push button into an extended position to be pushed so that said plunger head will pass under said second body member and liquid from said bottle will be discharged through said discharge spout when said push button is pushed; and means whereby said shell can be attached to a wall, with said bottle or bottles positioned substantially vertically.

8. A liquid-dispensing device according to claim 7, wherein a flow passage for liquid from the bottle to the discharge spout is provided by the plunger rod being smaller in diameter than the plunger head, by the provision of flow passages through the valve sealing means carried by the plunger rod, and by the provision of an annual shoulder internally of the first valve body member that restrains movement of said valve sealing means toward the first valve body member when the push button is pushed.

9. A liquid dispensing device according to claim 8, wherein the valve sealing means carried by the plunger rod comprises a slide ring slidably mounted on the plunger rod and formed to provide flow passages through such valve sealing means, and a sealing washer slidably and sealingly mounted on said plunger rod between said slide ring and the slideway cap.

10. A liquid dispensing device according to claim 9, wherein the slide ring is formed with an annular flow passage facing toward the plunger head, with an annular series of teeth facing oppositely, said teeth being spaced apart to provide flow passages therebetween, and with flow passages interconnecting said annular flow passage with said flow passages between said teeth.

11. A liquid dispensing device according to claim 10, wherein a sealing washer is carried by the plunger rod between the plunger head and the slide ring to seal the annular flow passage in the slide ring when the plunger head bears against the valve sealing means.

12. A liquid dispensing device according to claim 9, wherein a sealing washer is carried by the plunger rod between the plunger head and the slide ring to seal against the slide ring and close the flow passages through the valve sealing means when the plunger head bears against the valve sealing means.

13. A liquid dispensing device according to claim 7, wherein is included a check valve for preventing back flow of liquid from the valve means into the bottle.

14. A liquid dispensing device according to claim 7, wherein one or more bottle-viewing apertures corresponding to the one or more bottles are formed in the shell cover part adjacent to the valve means for enabling a user to determine when a bottle or bottles should be refilled.

15. A liquid dispensing device according to claim 7, wherein the one or more bottles are provided in their upper ends with respective refilling orifices and removable and replaceable covers for said orifices, respectively.

16. A liquid dispensing device according to claim 7, including key-unlockable, snap-locking means for preventing unauthorized opening of the shell.

17. A liquid dispensing device, comprising a shell for enclosing one or more liquid-containing bottles, said shell having a part for receiving and holding said one or more bottles and a cover part for the bottle holding part; one or more elongate bottles adapted to be received and held by said bottle-holding part, each of said one or more bottles having a liquid-dispensing opening with valve means at its bottom, said valve means including mechanism that is operable back and forth along an axis substantially normal to the longitudinal axis of its associated bottle by means of a push button that is adapted to extend through said cover for manual operation by the user of the device for operating said valve means, and having a downwardly extending discharge spout through which liquid from its associated bottle will be discharged when the valve means is operated, and resilient means for returning the push button and valve mechanism to closed position; means whereby said shell can be attached to a wall, with said bottle or bottles positioned substantially vertically; a pair of elongate and resilient tabs rising inwardly of the shell from the bottle-holding shell part thereof and cantilevered from attachment at one of their ends to said shell part and formed as hook members at their opposite ends, the individual tabs of said pair being arranged in staggered formation forwardly and backwardly of a keyhole in the cover shell part and at opposite sides of said keyhole; and a correspondingly located and arranged pair of hook members depending inwardly of said shell from the cover part thereof for locking interengagement with said hook members of said elongate tabs said elongate and resilient tabs and pair of hook members forming a key-unlockable, snap-locking means for preventing unauthorized opening of the shell.

18. A liquid dispensing device according to claim 17, wherein resilient members are cantilevered from a shell part adjacent to the hook members for engagement with the other shell part as springs to force the shell parts apart upon unlocking of the shell.

19. A liquid dispensing device according to claim 17, wherein one or more bottle-viewing apertures corresponding to the one or more bottles are formed in the shell cover part adjacent to the valve means for enabling a user to determine when a bottle or bottles should be refilled.

20. A liquid dispensing device, comprising a shell for enclosing one or more liquid-containing bottles, said shell having a part for receiving and holding said one or more bottles and a cover part for the bottle holding part; one or more elongate bottles adapted to be received and held by said bottle-holding part, each of said one or more bottles having a liquid-dispensing opening at its bottom; valve means removably attached to each of said one or more bottles over said liquid-dispensing opening, each of said valve means including mechanism that is operable back and forth along an axis substantially normal to the longitudinal axis of its associated bottle by means of a push button that is adapted to extend through said cover for manual operation by the user of the device for operating said valve means, and having a downwardly extending, discharge spout through which liquid from its associated bottle will be discharged when the valve means is operated, and resilient means for returning the push button and valve mechanism to closed position; means whereby said shell can be attached to a wall, with said bottle or bottles positioned substantially vertically; and means on said receiving and holding part of said shell for individually removably receiving and holding each of said one or more bottles with valve means attached whereby each of said bottles with valve means attached may be individually and easily removed as desired for cleaning, filling, or replacement.

21. A bottle for use with a liquid-dispensing device wherein the liquid-dispensing device includes a shell for enclosing one or more liquid-containing bottles, said shell having a part for receiving and holding one or more bottles and a cover part for the bottle holding part, valve means adapted to be removably attached to each of the one or more bottles over a liquid-dispensing opening, each of said valve means including mechanism that is operable back and forth along an axis substantially normal to the longitudinal axis of its associated bottle by means of a push button that is adapted to extend through said cover for manual operation by the user of the device for operating said valve means, and having a downwardly extending, discharge spout through which liquid from its associated bottle will be discharged when the valve means is operated, and resilient means for returning the push button and valve mechanism to closed position, means whereby said shell can be attached to a wall, with said bottle or bottles positioned substantially vertically, and means on said receiving and holding part of said shell for individually removably receiving and holding each of the one or more bottles with valve means attached whereby each of said bottles with valve means attached may be individually and easily removed as desired for cleaning, filling, or replacement, said bottle comprising a liquid holding portion for holding a liquid to be dispensed by the liquid-dispensing device; a liquid-dispensing opening at the bottom of the bottle when the bottle is mounted in the liquid dispensing device, means for removably attached a valve means over said liquid-dispensing opening; check valve means associated with said liquid-dispensing opening to allow fluid to flow from the bottle but not back into the bottle; and means for allowing air to flow into the bottle as liquid flows from the bottle.

* * * * *